US005867871A

United States Patent [19]

Tasman

[11] Patent Number: 5,867,871

[45] Date of Patent: Feb. 9, 1999

[54] OUTWARDLY SWINGING SHOWER DOOR HINGE HAVING A CONCEALED KNUCKLE

[76] Inventor: Randy Tasman, 10 Lake Rd., Huntington, N.Y. 11746

[21] Appl. No.: 967,505

[22] Filed: Nov. 11, 1997

[51] Int. Cl.[6] ..... E05D 11/10

[52] U.S. Cl. ..... 16/335

[58] Field of Search ..... 16/334, 252, 284, 16/382, 390, 335; 49/381, 501, 399; 4/607, 557, 614

[56] References Cited

U.S. PATENT DOCUMENTS

| | | | |
|---|---|---|---|
| 3,835,585 | 9/1974 | Anderson et al. | 16/334 |
| 4,114,236 | 9/1978 | Vandervort | 16/335 |
| 4,439,888 | 4/1984 | Merillat | 16/335 |
| 4,823,438 | 4/1989 | Roloff | 16/307 |
| 4,949,427 | 8/1990 | Keller | 16/335 |
| 5,265,309 | 11/1993 | Oille | 16/262 |
| 5,367,745 | 11/1994 | Roloff | 16/312 |
| 5,448,799 | 9/1995 | Stein, Jr. | 16/225 |
| 5,588,181 | 12/1996 | Sutton | 16/252 |
| 5,613,276 | 3/1997 | Franz | 16/229 |

*Primary Examiner*—Chuck Y. Mah
*Attorney, Agent, or Firm*—Kenyon & Kenyon

[57] ABSTRACT

A shower door hinge having a door clamping member, a wall mounting plate and a concealed knuckle device is presented. The door clamping member engages the shower door while the wall mounting plate is mounted on a side wall of the shower stall. The knuckle device, which is comprised of several parts, is enclosed within the door clamping member and thereby hidden from view. The knuckle device has, as a first and second part, a hinge and a hinge pin which form the axis of rotation about which the shower door rotates. The knuckle device also has, as another part, a spring biased pin which cooperatively acts with the hinge. The cooperative action between the hinge and the spring biased pin allow for a camming action which controls both the rate of rotation and the positioning of the shower door around the axis of rotation.

8 Claims, 7 Drawing Sheets

OUTWARDLY SWINGING SHOWER DOOR HINGE HAVING A CONCEALED KNUCKLE

FIELD OF THE INVENTION

The present invention relates to a decorative shower door hinge, and more particularly, to a wall mounted decorative outwardly swinging shower door hinge having a concealed knuckle.

BACKGROUND INFORMATION

Bathroom design and interior decorating of the bathroom have achieved a significant level of importance in the overall appearance of a home. Architects and homeowners today, therefore, are insisting that every detail of the bathroom appearance be decorative and precise.

Unfortunately, when it came to installing a new shower stall or tub, available shower hinges are in many instances not in conformance with the otherwise highly decorative theme of the bathroom. Shower hinges are typically bulky, exposed mechanical devices, leaving little to the imagination. For instance, U.S. Pat. No. 5,367,745, issued to Roloff on Nov. 29, 1994, relates to a hinge for shower stall doors. The shower door hinge has two separate members held in place by a hinge pin (pintle). The first member has two axially aligned sleeves which receive an axially aligned sleeve of the second member. The hinge pin passes through the member's sleeves and defines the axis of the hinge about which the shower door can be swung. The hinge pin can be removed, having at one end an annular flange or head, while at the other end a screw thread for engagement of a screw. Thus the design of this shower door hinge leaves exposed the two member's sleeves, the pintle and screw. Further, there exists the possibility that the screw will eventually become unscrewed and work its way loose, such that the hinge pin will fall out and the shower door will fall off.

U.S. Pat. No. 5,588,181, issued to Sutton on Dec. 31, 1996, relates to hinge for a glass shower door. The shower door hinge is constructed having a "u" shaped clamping member which clamps onto the shower door, and a "h" shaped strip which attaches to a supporting wall. At the end of the "h" shaped strip away from the point of attachment to the wall, the strip is shaped to form a channel (sleeve) through which a pin is inserted. This portion of the strip has a cut-out section in which a portion of the clamping member, also shaped in the form of a channel (sleeve), is inserted. The clamping member and the strip are then connected axially by insertion of the pin. The pin creates a point of rotation for the hinge about which the shower door rotates. This shower door hinge design too leaves exposed the pin and channels in which the pin fits. Further, the pin may come loose and the clamping member, due to its design, may eventually lose its hold on the shower door with repeated use.

U.S. Pat. No. 5,448,799, issued to Stein, Jr. on Sep. 12, 1995, relates to a panel hinge structure which can be employed to rotatably join two panel members such as a shower door and a shower enclosure assembly. The first member has extending from it an elongated web terminating in an axially aligned rod. The rod itself may be encased in a sleeve. The second member has an internal keyway which includes an axially aligned tubular channel. This tubular channel rotatably captures the axially aligned rod of the first member. The fit of the rod into the tubular channel creates the axis of rotation about which the hinge swings. A separate series of pieces, referred to as gudgeon clips, at the top of each of the first and second member prevents the rod from becoming disengaged from the tubular channel. The design of this hinge leaves exposed the rod of the first member. Further, if the gudgeon clips fail to work, become dislodged themselves, or even break, the rod will become disengaged from the channel and the shower door will fall off.

Thus, there is a need for a decorative shower door hinge in which the knuckle of the hinge is not exposed and which is protective of the glass door to which it is attached. The industry, as can be seen, has heretofore failed to provide such a shower door hinge having a concealed knuckle which is aesthetically pleasing and in conformance with contemporary design features.

SUMMARY OF THE INVENTION

Accordingly, it is an object of the present invention to provide a decorative wall mounted shower door hinge which satisfies the aesthetic taste of today's family while also being of a rugged design capable of withstanding continuous and repetitive use.

Another object of the present invention is to enable construction of a wall mounted shower door hinge in which the knuckle or joint of the hinge is concealed from view without reducing an adequate range of motion for the opening and closing of the shower stall door.

It is a further objective of the present invention to allow for construction of an outwardly swinging shower door hinge having a concealed knuckle which is both practical and has a reasonable cost to manufacture.

Yet another object of the present invention is to construct a shower door hinge having a hidden knuckle which is mountable either on a wall or another piece of glass.

To achieve the foregoing and further objectives, and in accordance with the purposes of the present invention, as embodied and broadly described herein, the present invention is directed to a decorative outwardly swinging shower door hinge having a hidden knuckle.

The shower door hinge is constructed, according to an embodiment of the present invention, to have a door clamping member, a wall mounting plate and a knuckle device. The door clamping member engages the shower door while the wall mounting plate is mounted on a side wall of the shower stall. The knuckle device acts as the point of rotation for the shower door hinge.

The door clamping member itself has a decorative front plate which engages a front side of the shower door and a rear plate which engages a rear side of the shower door. A gasket, made of rubber or other similar material, is placed between each of the two plates of the door clamping member and the respective sides of the shower door. The wall mounting plate itself is mounted to the wall and holds the structure of the shower door hinge, and correspondingly the shower door, in place.

The knuckle device, which is comprised of several parts, is enclosed within the door clamping member, thereby hidden from view. The knuckle device has, as a first and second part, a hinge and a hinge pin which form the axis of rotation about which the shower door rotates. The knuckle device also has, as another part, a spring biased pin which cooperatively acts with the hinge. The cooperative action between the hinge and the spring biased pin allow for a camming action which controls both the rate of rotation and the positioning of the shower door around the axis of rotation.

The present invention and its features and advantages will become more apparent from the following detailed description with reference to the accompanying drawings.

DETAILED DESCRIPTION

Figure 1:
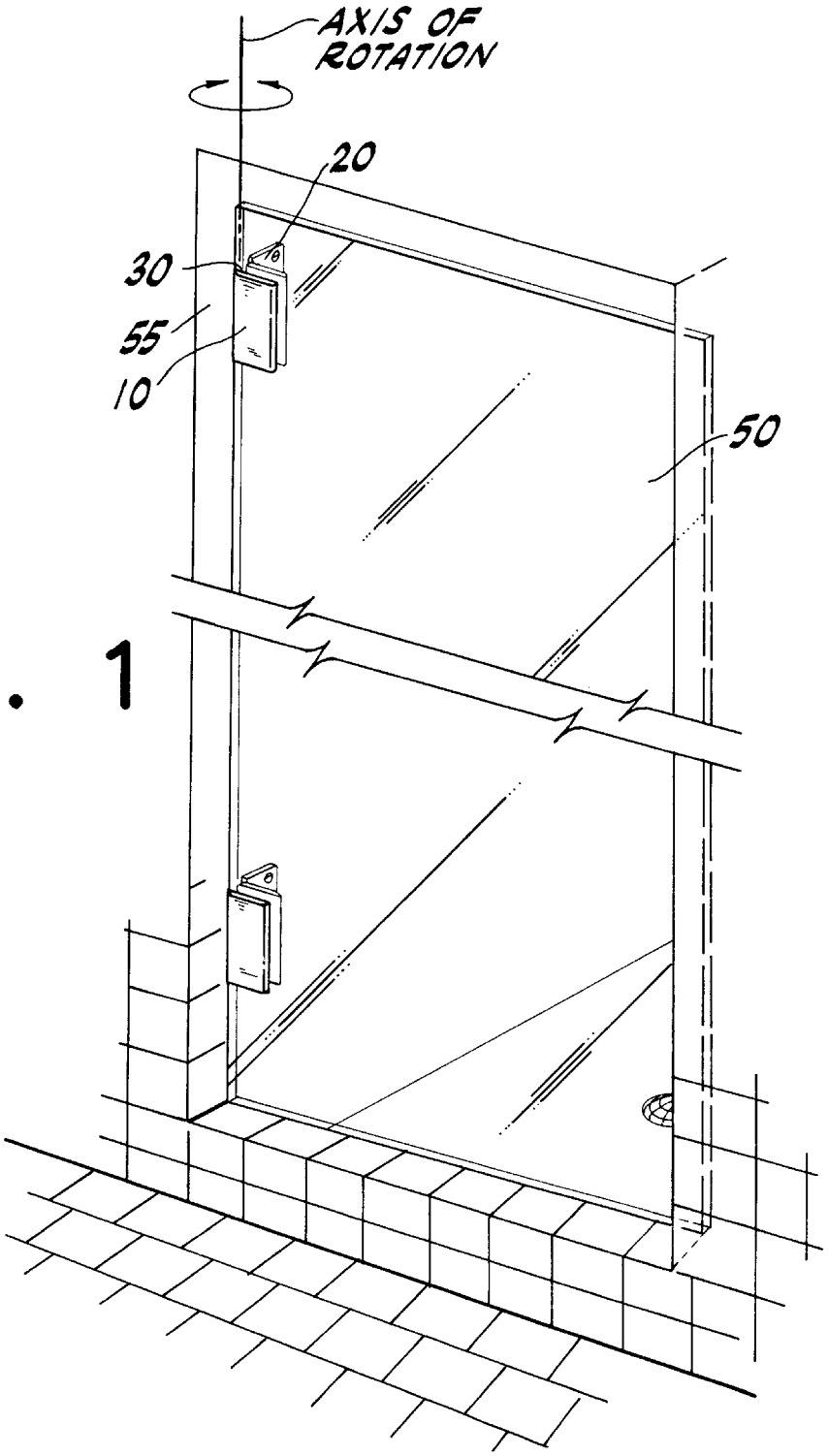
FIG. 1 shows a view of a shower door mounted by an embodiment of the present invention to the wall of a shower stall.

FIGS. 1 to 7 show an outwardly swinging shower door hinge having a concealed knuckle, according to an embodiment of the present invention. Referring to FIG. 1, the shower door hinge comprises a door clamping member 10, a wall mounting plate 20 and a concealed knuckle device 30. The door clamping member 10 engages a shower door 50, while the mounting plate 20 is attached to a shower stall wall 55. The knuckle device 30 cooperatively joins the door clamping member 10 and the mounting plate 20, and acts as the axis of rotation about which the shower door 50 rotates. FIG. 1 shows the preferred embodiment in which two such wall mounted shower door hinges are used. It is, of course, to be understood that one or more than one shower door hinge may be used/installed in the shower stall for use with the shower door.

Figure 2:
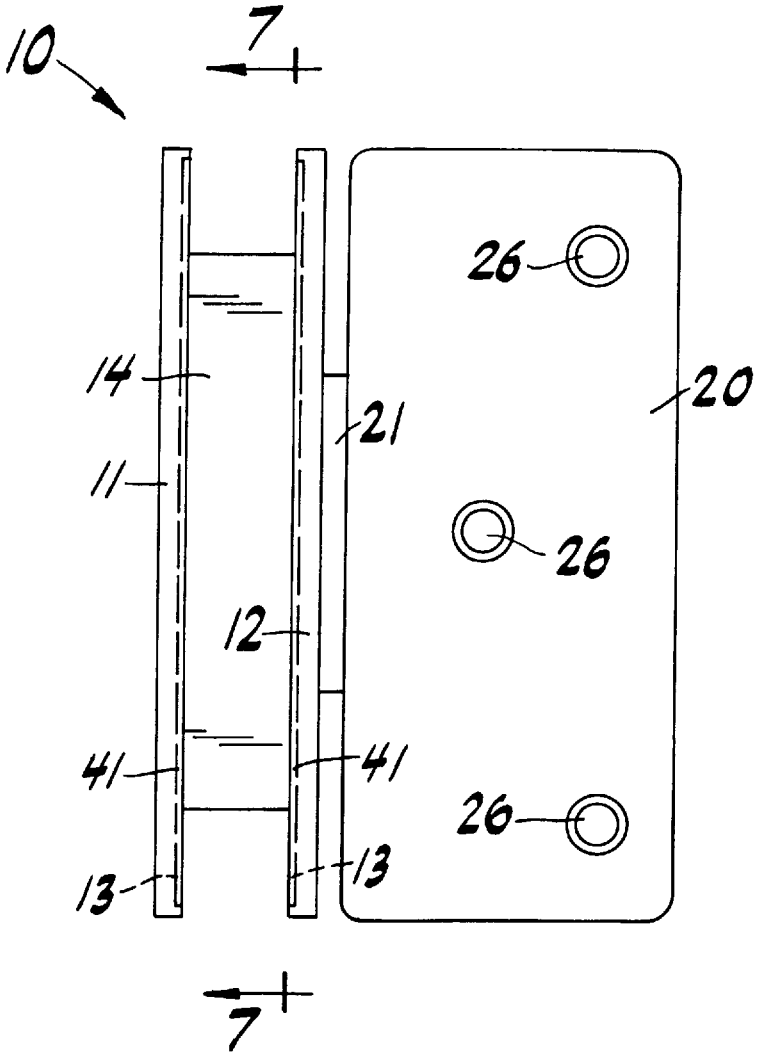
FIG. 2 shows a right side view of the shower door hinge where the shower door clamping member is directed towards the viewer, according to an embodiment of the present invention.
Figure 3:
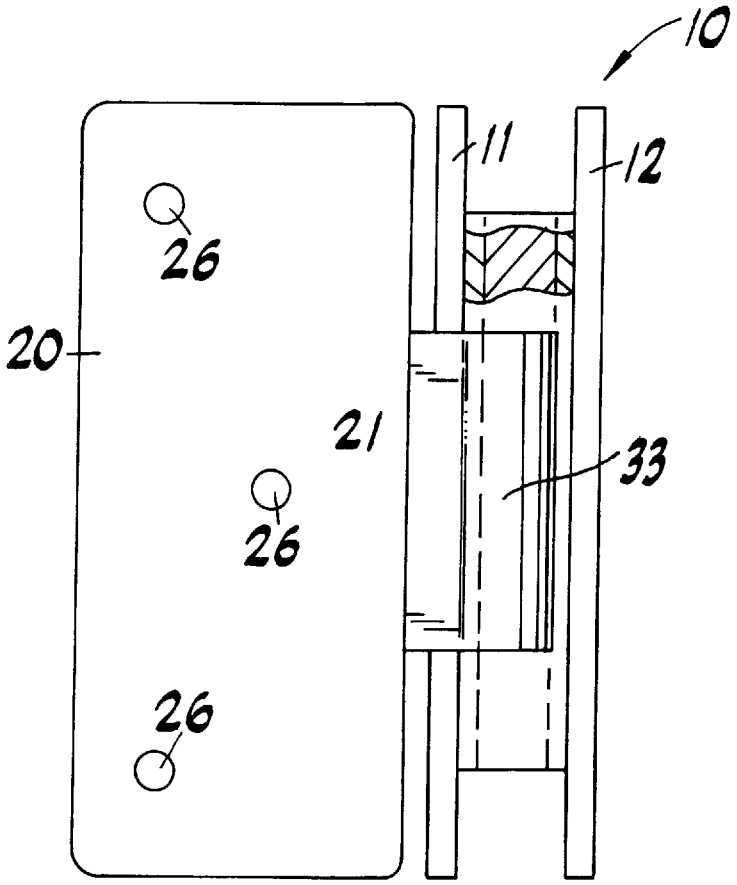
FIG. 3 shows a left side view of the shower door hinge where the shower door clamping member is directed away from the viewer, according to an embodiment of the present invention.
Figure 4:
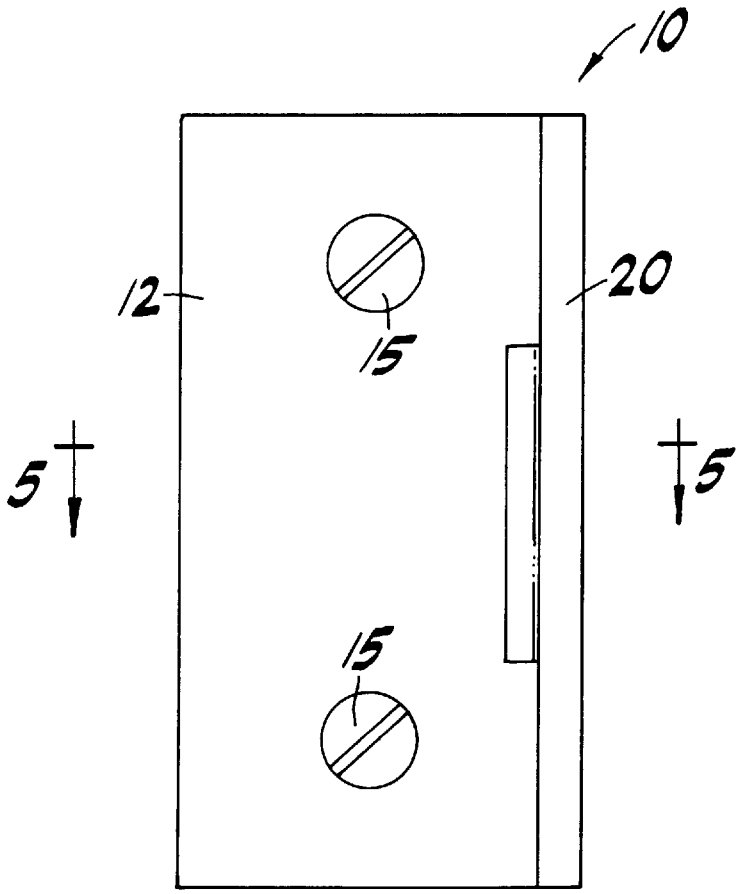
FIG. 4 shows a right side view of the shower door hinge where the wall mounting plate is directed towards the viewer, according to an embodiment of the present invention.

Referring to FIGS. 2, 3 and 4, the door clamping member 10 has a decorative front plate 11 which engages a front surface of the shower door 50 and a rear plate 12 which engages a rear surface of the shower door 50. A gasket 13, made of rubber or other similar material, is placed in each recess 41 found in each of the door engaging sides of the front plate 11 and the rear plate 12. Placement of the gasket 13 is thus between each of the two plates of the door clamping member 10 and the respective surfaces of the shower door 50. Each recess 41 is of a depth slightly greater than the gasket 13 to avoid exposure of the gasket 13. Gasket 13 serves to prevent scratching of the surfaces of the shower door 50 and/or to prevent water leakage out of the shower stall from between the shower door and the shower door hinge.

The decorative front plate 11 and the rear plate 12 of the door clamping member 10 are connected and held together by a beveled plate retainer screw 15. The plate retainer screw 15 is screwed through a countersink screw hole (not shown) cut in the rear plate 12 and into a countersink screw thread bore 16 in a knuckle compartment 14. The knuckle compartment 14 is integrally attached to the decorative front plate 11. Thus the rear plate 12 is removable from the front plate 11 and knuckle compartment 14 by unscrewing the plate retainer screw 15. This removableness of the rear plate 12 allows for shower door 50 removal and/or repair of the concealed knuckle device 30. A preferred embodiment of the present invention calls for two plate retainer screws 15, as shown in FIG. 4. It is, of course, to be understood that one or more than one retainer screws 15 may be used to secure the two plates of the door clamping member 10 together.

Referring further to FIGS. 2, 3 and 4, the wall mounting plate 20 can be mounted to the shower stall wall 55 by a screw (not shown). The screw is screwed through a countersink hole 26 and into the shower stall wall 55. The screw must be suitable to securely fasten the entire assembly of the shower door hinge and shower door to the wall, taking into account their combined weight. In the preferred embodiment, as shown, the wall mounting plate 20 has three countersink holes 26 for three screws. It is, of course, to be understood that one or more than one screw may be used, or that any wall fastening devices or method suitable to securely fasten the wall mounting plate 20 to the shower stall wall 55 may be used. Further, the wall mounting plate 20 has integrally connected to it a neck 21. The neck 21 extends laterally away from the body of the wall mounting plate 20 to enable the concealed knuckle device 30 to freely rotate about the axis of rotation.

Figure 5:
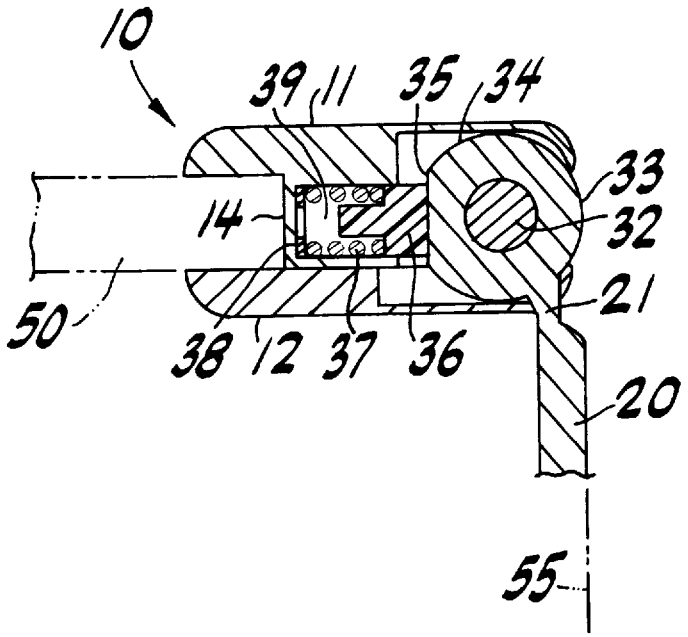
FIG. 5 shows a top cut-away view of the shower door hinge in a first position, cut-away along axis 5—5 of FIG. 4, according to an embodiment of the present invention.
Figure 6:
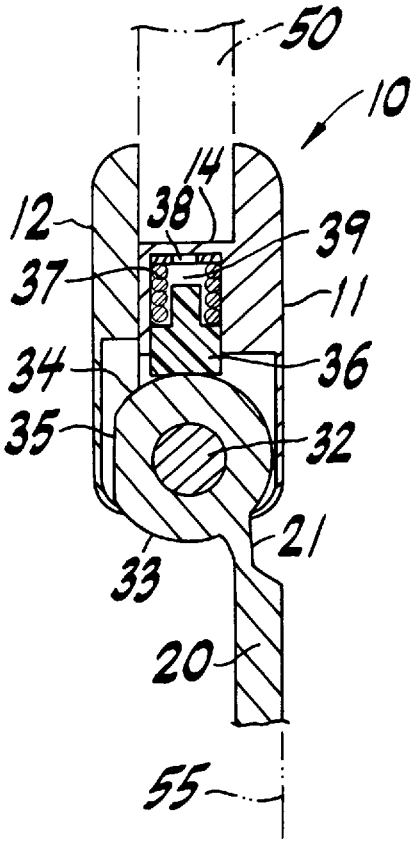
FIG. 6 shows a top cut-away view of the shower door hinge in a second position, cut-away along axis 5—5 of FIG. 4, according to an embodiment of the present invention.
Figure 7:
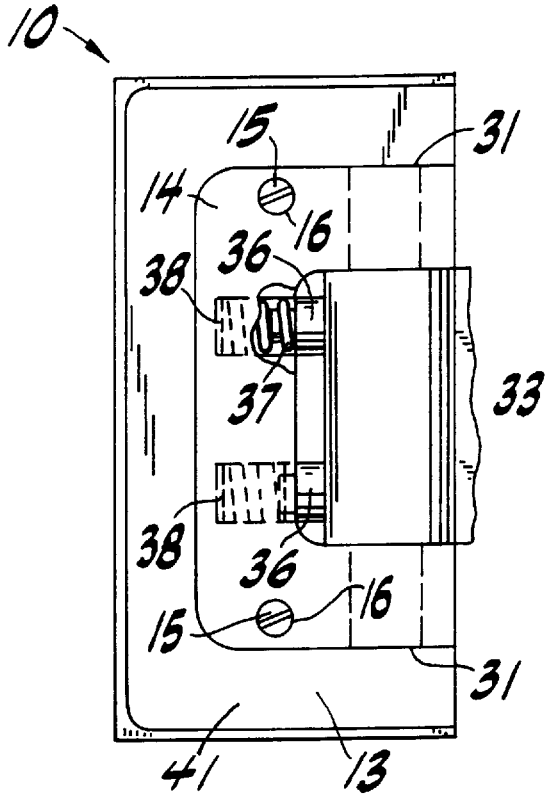
FIG. 7 shows a side cut-away view of the shower door clamping member of the shower door hinge, cut-away along axis 7—7 of FIG. 2, according to an embodiment of the present invention.

Referring to FIGS. 5, 6 and 7, the knuckle compartment 14, integrally attached to the decorative front plate 11, acts to conceal the knuckle device 30 from view. The knuckle compartment 14 has a vertical throughbore 31 centered on the axis of rotation about which the shower door 50 rotates. Inserted through the vertical throughbore 31 is a hinge pin 32, which extends the entire vertical length of the knuckle compartment 14. The vertical throughbore 31 itself, though, has a hollow area into which a hinge 33 is inserted/contained.

The hinge 33 extends from and is integrally connected to the neck 21 of the wall mounting plate 20. The hinge 33 has a substantially circular outer surface 34 with a flat cam surface 35 on one side, thus helping to create a camming effect (discussed below) when the door clamping member 10 and shower door 50 are rotated, as shown in FIGS. 5 and 6. Further the hinge 33 has an axial throughbore for receiving the hinge pin 35. Thus the hinge pin 35 acts to keep the hinge 33 in place, and is the focal point for the axis of rotation.

The flat cam surface 35 and the circular outer surface 34 of the hinge 33 are acted against by a biasing pin 36. Biasing pin 36 is biased against the hinge 33 by a biasing spring 37. The biasing pin 36 and biasing spring 37 are contained within a hollow bore 39 cut in the knuckle compartment 14. A washer 38 may be placed at the end of the hollow bore 39 to help keep the biasing spring 37 in place. The biasing pin 36 is shaped to help guide the biasing spring 37. It is, of course, to be understood that one or more than one biasing pin 36 may be used. FIG. 7 shows a preferred embodiment where two biasing pins 36 are used.

Referring specifically to FIGS. 5 and 6, the camming action of the knuckle device 30 is created by the biasing force of the biasing spring 37 acting against the biasing pin 36. The biasing pin 36 in turn acts against the circular outer surface 34 and the flat cam surface 35 of the hinge 33. As shown in FIG. 5, the shower door 50 is in a closed position. Thus the biasing spring 37 is fully extended and the biasing pin 36 is flush against the flat cam surface 35. When the shower door 50 is moved to the open position, as shown in FIG. 6, the biasing pin 36 rides over the edge between the flat cam surface 35 and the circular outer surface 34 of the hinge 33. The movement of the biasing pin 36 causes the biasing spring 37 to contract, increasing the biasing force against the biasing pin 37. This camming action allows controlled movement of the shower door 50, and acts to "lock" the shower door 50 in either an open or closed position. Movement is effected by the shower user simply by grasping the shower door 50 and pushing or pulling in the desired direction.

It is to be understood and expected that variations in the principles of construction herein disclosed may be made by one skilled in the art and it is intended that such modifications, changes, and substitutions are to be included within the scope of the present invention.

What is claimed is:

1. A wall-mounted outwardly-swinging shower door hinge assembly with a concealed knuckle, comprising:

a door clamping member for grasping the shower door on a front and rear side thereof, the clamping member having a front decorative plate adapted to cooperatively engage the front side of the shower door and a cooperative rear plate engageable with the rear side of the shower door, the front decorative plate further having a substantially uninterrupted decorative outer surface;

a hinge pin housed within and supported between said front and rear plates; and a wall mounting plate having at least one aperture for receiving at least one wall engaging fastener therethrough and a forwardly extending hinge adapted to receive said hinge pin therethrough, the hinge having a substantially circular outer surface with a flat on one side thereof and being sized to fit within the front and rear plates of the door clamping member;

wherein said hinge pin acts to cooperatively hold the door clamping member in swinging engagement with the wall mounting plate and is the focal point for an axis of rotation between the two.

2. The wall-mounted outwardly-swinging shower door hinge assembly with a concealed knuckle in accordance with claim 1, which further includes a spring member disposed in apertures disposed within the door clamping member and which are biased into and engageable with the outer surface of the hinge.

3. The wall-mounted outwardly-swinging shower door hinge assembly with a concealed knuckle in accordance with claim 2, wherein said spring member and the hinge create a camming effect by which a speed of rotation of the shower door about the axis of rotation can be controlled as well as a positioning of the shower door.

4. The wall-mounted outwardly-swinging shower door hinge assembly with a concealed knuckle in accordance with claim 1, wherein each of the front and rear plates of the door clamping member have recesses on the shower door engaging sides thereof, and a gasket member respectively disposed therein for engagement with the shower door, the recess being of a depth slightly greater than the thickness of the gasket member to avoid any exposure of the gasket member.

5. An outwardly-swinging shower door hinge assembly having a concealed knuckle, comprising:

a door clamping member having a front plate and rear plate, for respectively engaging a front side and a rear side of the shower door, and further having a hollow compartment housed between and attached to one of said front and rear plates, said hollow compartment having a first axial throughbore extending therethrough;

a wall mounting plate, for mounting the shower door hinge assembly on a wall of a shower stall, having a hinge extending from a neck on the wall mounting plate and sized to fit into the hollow compartment, the hinge having a substantially circular outer surface, a flat cam surface on one side and a second axial throughbore;

a knuckle device having a hinge pin adapted to fit in said first axial throughbore of said hollow compartment and at least one biasing pin disposed within said hollow compartment, both for engagement with the hinge;

wherein the hinge pin is inserted through the first and second axial throughbores and acts as an axis of rotation about which the shower door swings.

6. The outwardly-swinging shower door hinge assembly having a concealed knuckle according to claim 5, wherein the at least one biasing pin is biased against the hinge by at least one biasing spring.

7. The outwardly-swinging shower door hinge assembly having a concealed knuckle according to claim 6, wherein the biasment of the at least one biasing spring and at least one biasing pin against the hinge creates a camming effect in which a rate of rotation and a position of the shower door around the axis of rotation can be controlled.

8. The outwardly-swinging shower door hinge assembly having a concealed knuckle according to claim 5, wherein a gasket is placed between each of the front and rear plates of the door clamping member and the respective front and rear sides of the shower door.

* * * * *